United States Patent [19]

O'Neill

[11] 4,083,454

[45] Apr. 11, 1978

[54] MAILING AND STORAGE BOX

[75] Inventor: James L. O'Neill, Scituate, Mass.

[73] Assignee: Merkert Enterprises Co., Canton, Mass.

[21] Appl. No.: 827,955

[22] Filed: Aug. 26, 1977

[51] Int. Cl.[2] ..... B65D 5/54

[52] U.S. Cl. ..... 206/605; 206/611; 229/37 R; 229/40; 220/410

[58] Field of Search ..... 206/611, 613, 608, 609, 206/605; 229/37 E, 40, 14 BW, 14 R, 16 R, 37 R

[56] References Cited

U.S. PATENT DOCUMENTS

| | | | |
|---|---|---|---|
| 2,758,780 | 8/1956 | Imbs | 229/14 R |
| 3,065,896 | 11/1962 | Grapp | 206/611 |
| 3,099,381 | 7/1963 | Meyers | 229/37 R |
| 3,161,346 | 12/1964 | Svensson | 206/607 |
| 3,298,596 | 1/1967 | Tolaas et al. | 206/608 |
| 3,708,104 | 1/1973 | Buttery | 206/608 |
| 3,918,631 | 11/1975 | Hackenberg | 229/37 R |
| 4,049,190 | 9/1977 | O'Neill | 206/611 |

*Primary Examiner*—Stephen P. Garbe
*Attorney, Agent, or Firm*—Wolf, Greenfield & Sacks

[57] ABSTRACT

An end-loading reinforced mailing or shipping box is formed from a single blank of sheet material and includes integral extensions which are wrapped about the box to define a surrounding protective shipping wrapper. The box may be of the top-opening variety. The protective wrapper includes end flaps which provide additional reinforcement at the ends of the package. Assembly of the integral box and wrapper requires only one straight line gluing operation by the box manufacturer and only one folding and gluing operation by the packager who receives the box and wrapper in a partly folded and glued condition. The packager end loads the products or articles into the open ended package and then needs only to fold and glue the end flaps. No right angle or timed folding or gluing operations are required. The package includes tear strips which facilitate opening a wall of the wrapper and permit the inner box to be removed. Thereafter, the box-like wrapper may be used as a protective storage box for the inner box.

7 Claims, 9 Drawing Figures

Fig.6
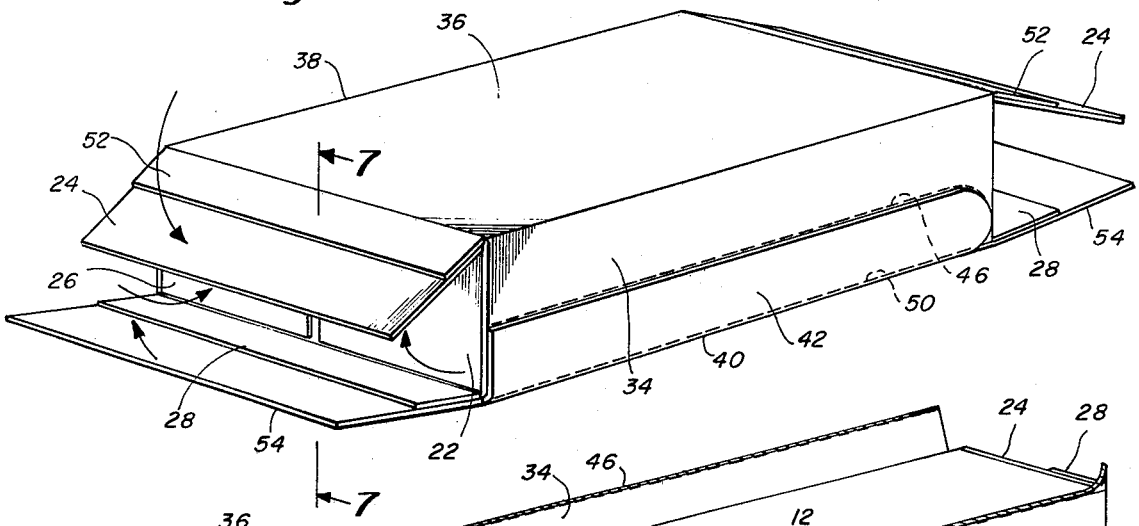
Fig. 7
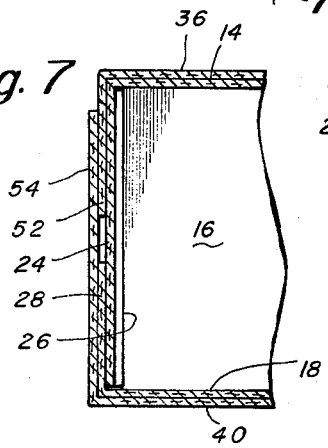
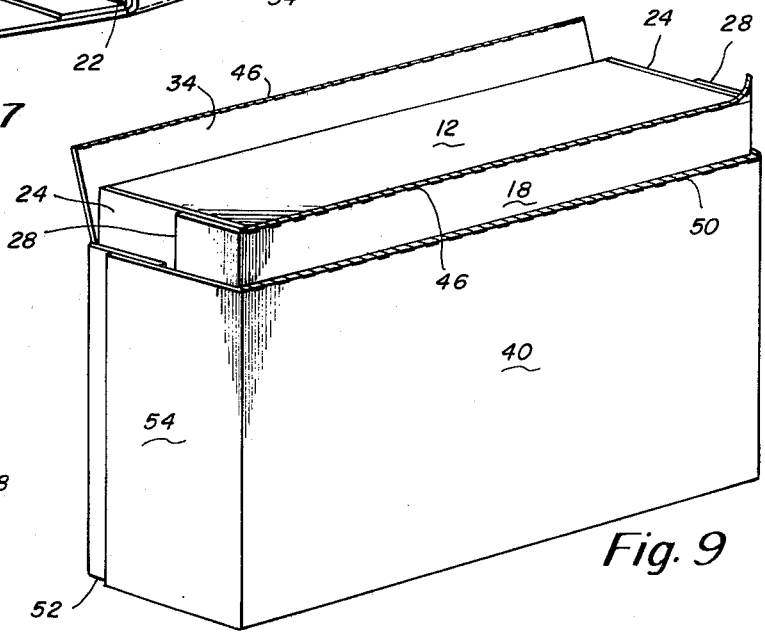
Fig. 9
Fig. 8
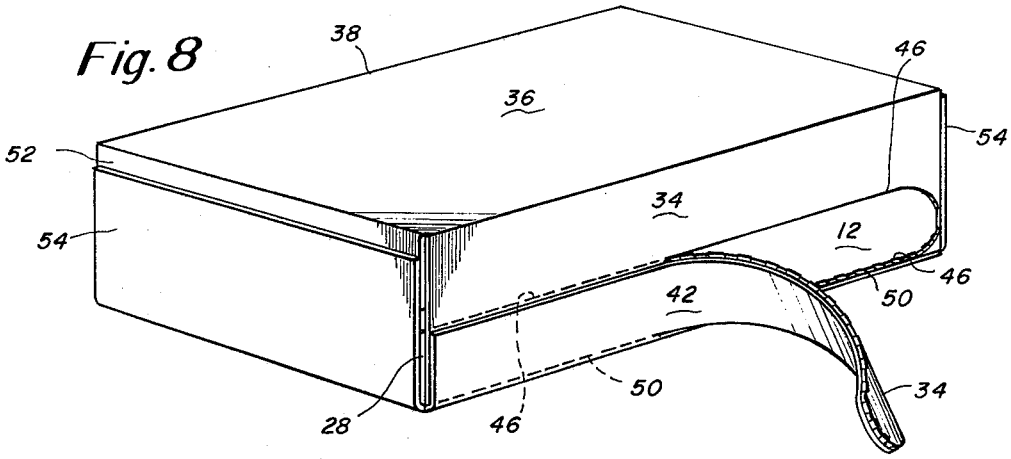

MAILING AND STORAGE BOX

BACKGROUND AND SUMMARY OF THE INVENTION

This invention relates to containers such as boxes, for example, of a type which may be used to mail or ship a variety of products. By way of example only, the box of the present invention is of particularly utility when it is desired to provide a box having a protective cover or wrapper and in which the box may be separated easily from the wrapper to enable the box to be reused as a storage container if desired. By way of example, the box may be used to ship articles or products, such as consumer samples, or to mail check blanks to bank customers. More particularly, the present invention relates to end-loadable boxes which may be manufactured and then shipped to the packager so that they can be loaded and finally sealed in a simplified and inexpensive manner while providing optimum protection for the article in the package. In my copending U.S. patent application Ser. No. 744,953 now U.S. Pat. No. 4,049,190 filed Nov. 26, 1976, a mailing and storage box is disclosed, having a one-piece blank which may be cut from sheet material to define one portion foldable into a tray or inner box and a detachably connected wrapper portion which surrounds the box. While the blank and box described in said application achieves numerous advantages over the prior art and in most instances will be well suited for its intended purposes, there may be some instances in which it is preferred to provide still further protection for the article or product within the box, particularly by further reinforcing the ends of the box. Also, in some instances, it may be desirable to retain the wrapper portion in a form suitable to receive and continue to protect the inner box. It is among the general objects of the invention to provide such an improvement.

In brief, the invention utilizes a single blank which is foldable to define the inner box as well as an integral protective wrapper which may be separated from the box. The entire structure requires a single die cut and utilizes only straight line, untimed gluing and folding machinery. The blank includes a box-defining portion and a wraper-defining portion, which is connected to the box-defining portion. The box-defining portion includes four serially connected panels and an edge glue flap. Each of the panels has an end flap extending therefrom which fold to enclose the ends of the box portion. The wrapper extension similarly includes four panels which are foldable to overlie the panels of the box portion. The panel of the wrapper extension which is attached to the box portion includes a weakened zipper region. The outer extremity of the wrapper portion includes a glue flap which, when the wrapper portion is wrapped about the box portion, is attached to the zipper strip which will cause the entire wrapper to detach in its entirety when the box is opened. A pair of alternate of the wrapper panels each has a pair of end flaps which cooperate with the end flaps on the box portion of the blank to provide a multiple thickness reinforced end construction for the wrapped package.

The blank is die cut and fold-scored in a single die cutting operation. The box is then folded by the manufacturer with the wrapper portion wrapped about the box. Only simple, straight line, untimed gluing operations need be employed by the manufacturer. The resulting sleeve-like prewrapped and preglued boxes shipped to the packager in a flattened configuration.

The packager need only insert the product through one of the open ends of the sleeve and then fold and glue the end flaps of the box and outer wrapper which are exposed through the open ends of the wrapper. Here, again, only untimed, straight line gluing and/or folding procedures are required. The package then is ready to be mailed or otherwise shipped. The container is opened by the user by simply tearing the preweakened tear strip formed in the wrapper portion of the package which opens one of the side walls of the wrapper. The inner box may be removed through the opened side wall. The wrapper remains in its box-like form having an open side which enables it to be reused as a protective enclosure for the inner box.

It is among the objects of the invention to provide an improved end-loading box and protective covering in which the number of manufacturing and handling steps is reduced.

A further object of the invention is to provide a package of the type described which can be made from a single blank and which requires only the use of untimed, straight line gluing and/or folding machinery and which does not require the more expensive right angle gluing or folding techniques.

Another object of the invention is to provide a package of the type described having improved protective flaps integral with the wrapper to enhance the protection afforded at the ends of the box.

Still another object of the invention is to provide a package of the type described having an improved wrapper construction for use in shipping and in which the wrapper opens in a manner which enables it to be reused as a receptacle for the inner box.

DESCRIPTION OF THE DRAWINGS

The foregoing and other objects and advantages of the invention will be appreciated more fully from the following further description thereof, with reference to the accompanying drawings wherein:

FIG. 6 is an illustration of the manner in which the end flaps are folded;

FIG. 7 is a sectional illustration of the end flaps as seen along the line 7—7;

FIG. 8 is an illustration of the tear strip of the outer wrapper partly torn away; and FIG. 9 is an illustration of the inner box partly removed from the outer, wrapper-like box.

DESCRIPTION OF THE PREFERRED EMBODIMENT

Figure 1:
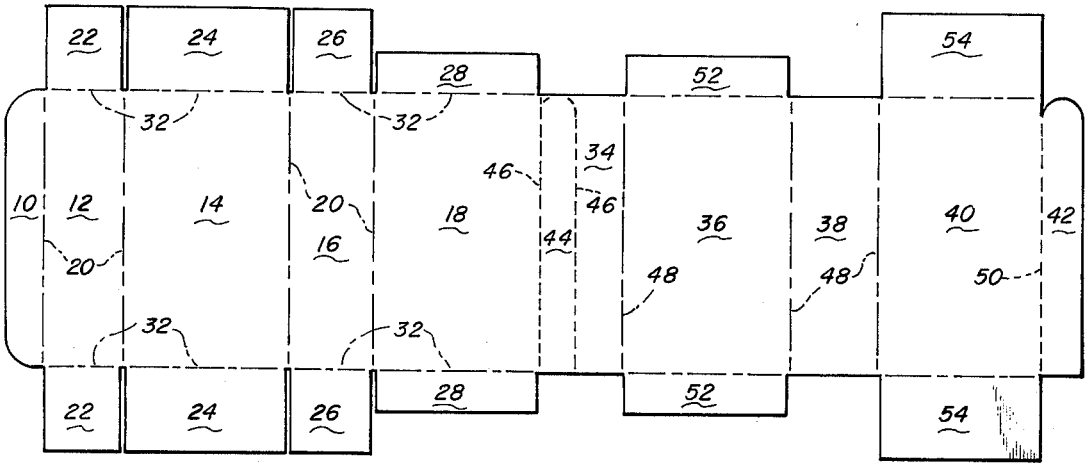
FIG. 1 is a plan view of the blank used in accordance with the invention as seen from the inside surface of the box.

FIG. 1 shows the one piece blank in accordance with the invention which includes, in serial connection, a lid front flap 10, a lid top panel 12, a tray rear panel 14, a tray bottom panel 16 and a tray front panel 18, each of which is separated and defined by an infold score line 20. The lid top panel 12 has a pair of inner minor end flaps 22 extending from its opposite ends. Rear panel 14 has a pair of major end flaps 24. Tray bottom panel 16 has a pair of minor end flaps 26. Tray front panel 18 has a pair of major end flaps 28 which are of reduced height less than the height of the end flaps 22, 24, and 26 associated with the other panels of the box segment. The width of each of the end flaps 22, 24, 26, 28 corresponds substantially to the width of its associated panel, each of the end flaps being separated from its adjacent end flaps by a slot indicated at 30. Each of the end flaps 22, 24 26 and 28 also is defined by an infold score line 32 with respect to its associated panel.

The wrapper segment of the blank is attached to, extends from and is a continuation of the tray front panel 18 and includes, in serial connection, a wrapper top panel 34, a wrapper rear panel 36, a wrapper bottom panel 38 and a wrapper front panel 40. Attached to the extreme end of the wrapper front panel 40 is a zipper glue strip 42. The connection between the wrapper segment and the tray segment is defined by a zipper strip 44 which is defined by a pair of parallel weakened lines 46, one of the weakened lines 46 being formed along the wrapper top panel 34 and the other being formed along the juncture of the wrapper top panel 34 and the tray front panel 18. The remaining wrapper panels are infolded at their junctures as indicated by the fold lines 48. The juncture between the front wrapper panel 40 and the zipper glue strip 42 is defined by a serrated line 50.

The wrapper rear panel 36 and wrapper front panel 40 are provided with wrapper major end flaps including the reduced height end flaps 52 which are attached to and extend from the wrapper rear panel 36 and the full height end flaps 54 which are attached to and extend from the wrapper front panel 40. Thus, the wrapper segment includes an arrangement in which the first wrapper panel has no end flaps and the remaining wrapper panels have end flaps on alternating wrapper panels, with the intermediate wrapper panels being free of end flaps.

From the foregoing, it will be appreciated that the entire blank can be die cut from a sheet of appropriate material in a single die cutting operation.

Figure 2:
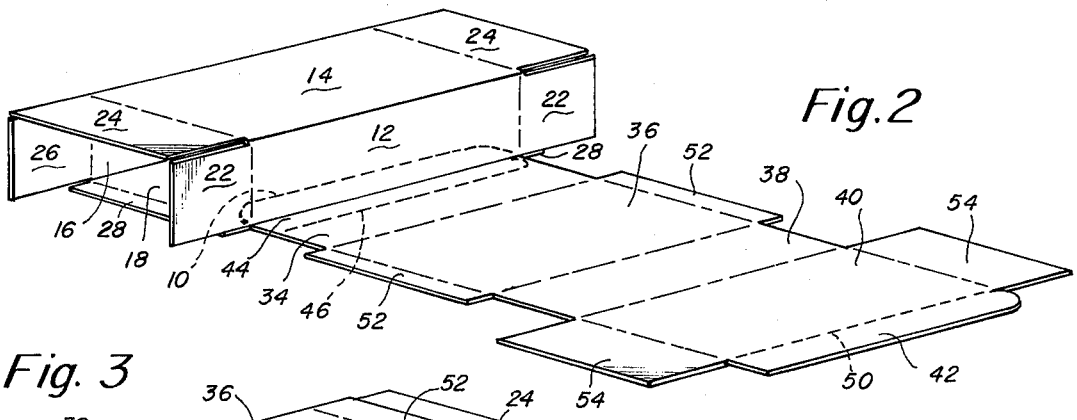
FIG. 2 is an illustration of the blank with its box portion folded and glued.
Figure 3:
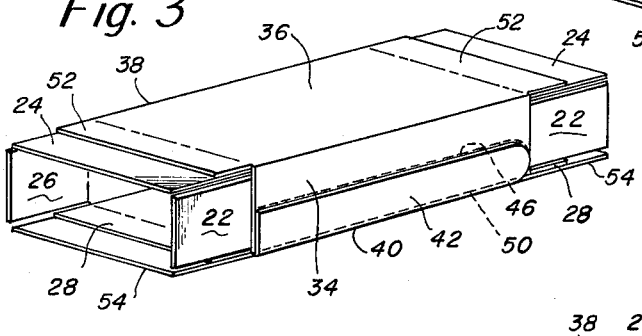
FIG. 3 is an illustration of the blank in its fully folded and glued configuration but with its ends open.
Figure 4:
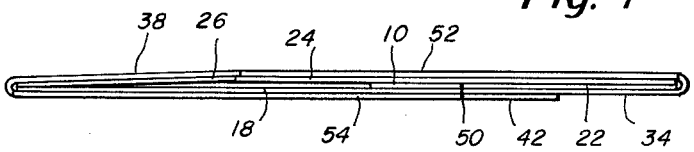
FIG. 4 is an end view of the blank in its flattened condition as it would be when shipped to the check printer.

In order to assemble the blank to its useable shippable configuration, ready for use by a manufacturer or packager, strips of glue are applied to the outwardly facing surfaces of each of the lid front flap 10 and the portion of the wrapper top panel 34 which defines the zipper segment 44. Because these portions of the blank are free from any end flaps or end protrusions, the strips of glue may be applied by straight line, untimed gluing machinery. As mentioned above, that provides significant savings in the manufacturing costs of the package. After the glue strips have been applied, the box segment is then folded to the configuration shown in FIG. 2 in which the outer surface of the lid front panel 10 is attached to the marginal edge portion of the tray front panel 18. The wrapper segment then is wrapped about the box segment so that the zipper strip 42 overlies the glue strip which was applied to the outer surface of the zipper segment 44 to adhere the zipper strip 42 to the zipper segment 44, as shown in FIG. 3. The open-ended package then may be folded to its flattened configuration shown in FIG. 4 and is then ready to be shipped to the packager who will use the box.

Figure 5:
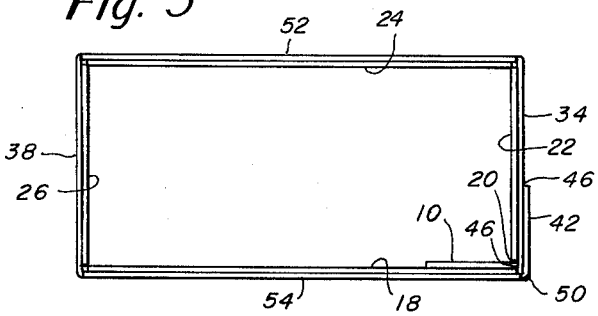
FIG. 5 is an end view similar to FIG. 4 of the package erected to receive the product.

The packager will erect the box to the configuration shown in FIGS. 3 and 5 and may then fold the various flaps at one end of the box, then load the box through the other end and then fold the flaps at the end of the box through which loading took place. FIG. 6 illustrates the sequence and manner in which the end flaps are folded. As shown, the inner minor flaps 22, 26 are first folded in. Then the major flaps 24, 52 are folded in. Then, glue strips, suggested at 56 and 58, are applied to each of the inner surfaces of end flaps 28 and 54 and those end flaps are folded to complete the end folding operation. Thus, the inwardly facing surface of the tray panel end flap 28 will be attached to the outwardly facing surface of tray major panel 24 and the wrapper major end flap 54 will be adhered to the outer surface of the wrapper end flap 52. When the ends are folded fully, the flaps are arranged as shown in FIG. 7.

The box may be opened by the ultimate user by simply tearing away the attached zipper strips 42, 44 as suggested in FIG. 8. That separates the inner box entirely from the wrapper and enables the box to be withdrawn through the then open top of the wrapper. The lid of the inner box then may be opened by severing the glued connection between the lid front flap and the tray front panel or, if there was no glued connection at that point, by simply lifting the lid. The wrapper, which remains in its box-like configuration because the end flaps 54, 28 remain attached, may be reused as a storage box for the inner box should that be desired.

Thus, by the foregoing, it will be appreciated that the invention results in significant advantages and improvements to each of the manufacturer, packager and user. Only one die cutting operation is required. The number of folding and gluing operations is reduced and their character simplified because of the omission of any requirement for right angle or timed gluing procedures. Moreover, the present invention is of particular utility where it is important to provide a high degree of reinforcement at the ends of the package. Also, the box and wrapper are reuseable as a storage unit.

It should be understood that the foregoing description of the invention is intended merely to be illustrative thereof and that other embodiments and modifications may be apparent to those skilled in the art without departing from its spirit.

Having thus described the invention, what I desire to claim and secure by Letters Patent is:

1. A blank for a container comprising:

a tray portion including a series of serially connected flaps and panels including, in sequence, a lid front flap, a lid panel, a tray rear panel, a tray bottom panel and a tray front panel, each of said panels having end flaps extending therefrom at opposite ends thereof, the end flaps associated with the tray front panel being of reduced height, said flaps and panels being foldable to define an end-loadable box configuration;

said blank further including a wrapper extension extending from and defining a continuation of the tray portion, said wrapper extension including, serially, a wrapper top panel, a wrapper rear panel, a wrapper bottom panel and a wrapper front panel;

said wrapper top panel having a weakened zipper strip formed therein and extending along the juncture of said wrapper portion and said tray portion;

the outer end of the wrapper front panel having a zipper glue strip extending therealong, said panels being foldable so that when the wrapper extension is wrapped about the box portion, the outer zipper will overlie and be in registry with the zipper formed in the wrapper top panel;

the wrapper front panel having a pair of end flaps extending therefrom; and the wrapper rear panel having a pair of end flaps extending therefrom and being of less height than the end flaps associated with the wrapper front panel.

2. A container formed from the blank defined in claim 1.

3. A blank as defined in claim 1 further comprising:

said reduced height end flaps of each of said wrapper rear panel and tray front panel being of substantially the same height.

4. A container formed from the blank defined in claim 3.

5. A blank as defined in claim 3 further comprising:

each of said top and bottom panels of the wrapper extension being free of any end flaps.

6. A container formed from the blank defined in claim 5.

7. A container formed from the blank defined in claim 1 and further comprising:

said end flaps of said wrapper front panel being attached to said end flaps of said wrapper rear panel whereby said wrapper may define an open-sided box-like, reusable container for that portion of the container which is formed from said tray portion.

* * * * *